United States Patent [19]

Kolb et al.

[11] Patent Number: 4,997,348

[45] Date of Patent: Mar. 5, 1991

[54] SPIRAL ROTARY PISTON DISPLACEMENT MACHINE WITH ADVANCED INLET SEALING LINE

[75] Inventors: Roland Kolb, Dielsdorf; Fritz Spinnler, Mellingen, both of Switzerland

[73] Assignee: BBC Brown Boveri AG, Baden, Switzerland

[21] Appl. No.: 530,423

[22] Filed: May 29, 1990

Related U.S. Application Data

[63] Continuation of Ser. No. 282,756, Dec. 12, 1988, abandoned.

[30] Foreign Application Priority Data

Dec. 21, 1987 [CH] Switzerland ..... 4981/87

[51] Int. Cl.[5] ..... F04C 18/04

[52] U.S. Cl. ..... 418/55.2

[58] Field of Search ..... 418/55 R, 55 A, 55 C, 418/55.1, 55.2, 55.4

[56] References Cited

FOREIGN PATENT DOCUMENTS 2603462 8/1976 Fed. Rep. of Germany .
3138585 7/1983 Fed. Rep. of Germany .
Ad. 48616 1/1938 France ..... 418/55 A
58-172405 10/1983 Japan .
2034409 6/1980 United Kingdom .

*Primary Examiner*—John J. Vrablik
*Attorney, Agent, or Firm*—Burns, Doane, Swecker & Mathis

[57] ABSTRACT

In a displacement machine for compressible media, having a delivery space (6) which is delimited by spiral-shaped peripheral walls (8, 9) extending perpendicularly from a side wall and leads from an inlet (2) outside the spiral to an outlet (3) inside the spiral, and having a spiral-shaped displacement body (5) which projects into the delivery space (6) and is mounted with respect to the delivery space so as to execute a rotary, twist-free movement, the center (10) of said displacement body is offset eccentrically relative to the center (11) of the peripheral walls (8, 9) in such a way that the displacement body (5) at all times almost touches both the outer and the inner peripheral wall (9 and 8 respectively) of the delivery space (6) at in each case at least one advancing sealing line. The sealing line at the inlet-side end of the outer peripheral wall (9) is advanced relative to the 0°/360° position by an angle ($\alpha$) between 5° and 50°, the peripheral wall (9) forming a circular arc (9') in this angle region.

2 Claims, 2 Drawing Sheets

SPIRAL ROTARY PISTON DISPLACEMENT MACHINE WITH ADVANCED INLET SEALING LINE

This application is a continuation of application Ser. No. 282,756, filed Dec. 12, 1988, abandoned.

BACKGROUND OF THE INVENTION

1. Field of the Invention

The invention relates to a rotary piston displacement machine for compressible media, having at least one delivery space which is delimited by spiral-shaped peripheral walls extending perpendicularly from a side wall of a fixed housing and leads from an inlet outside the spiral to an outlet inside the spiral, and having a spiral-shaped displacement body which projects into the delivery space and is mounted with respect to the delivery space so as to execute a rotary, twist-free movement and the center of which is offset eccentrically relative to the center of the peripheral walls in such a way that the displacement body at all times almost touches both the outer and the inner peripheral wall of the delivery space at in each case at least one advancing sealing line, and the spiral shape being selected so that the maximum theoretical inlet volume is achieved in the delivery space between displacement body and outer peripheral wall before the rotating rotor which carries the perpendicular displacement bodies assumes the 0°/360° position relative to the delivery space, in which position the displacement body rests against the outer peripheral wall.

2. Discussion of Background

A rotary machine, the principle of which is known from DE-C3 26 03 462, is suitable for supercharging an internal combustion engine. It is distinguished by a virtually pulsation-free delivery of the working medium, which consists, for example of air or an air/fuel mixture. During the operation of a supercharger of this kind, a plurality of crescent-shaped working spaces are enclosed along the length of the delivery space between the displacer and the two peripheral walls of the delivery space, said working spaces moving through the delivery space from the inlet towards the outlet. In the process, their volume progressively decreases, with a corresponding increase in the pressure of the working medium.

A machine of the type mentioned at the outset is known from DE-A-3,138,585. The fact that the maximum theoretical inlet volume is greater than the actually achievable volume is a result of the fact that the spiral is composed of a plurality of mutually adjoining circular arc segments, each having a progressively smaller radius. A schematic diagram with regard to this behavior is illustrated in FIG. 2, which will be described later. In the known machine, the first time that the displacement body rests against the outer peripheral wall during the rotary movement of the rotor is in the so-called 0°/360° position, at which point the intake procedure can be taken to be complete. However, tests using water models have shown that, given this configuration, a not inconsiderable part of the medium taken in flows back from the delivery space into the inlet during the closing procedure.

SUMMARY OF THE INVENTION

Accordingly, one object of this invention is to configure the inlet zone of such a machine in such a way that backflow is reduced, thereby improving the volumeteric efficiency.

According to the invention this is achieved by the fact that the sealing line at the inlet-side end of the outer peripheral wall is advanced relative to the 0°/360° position by an angle $\alpha$ between 5° and 50°, the peripheral wall forming a circular arc in this angle region.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings, wherein.

Figure 1:
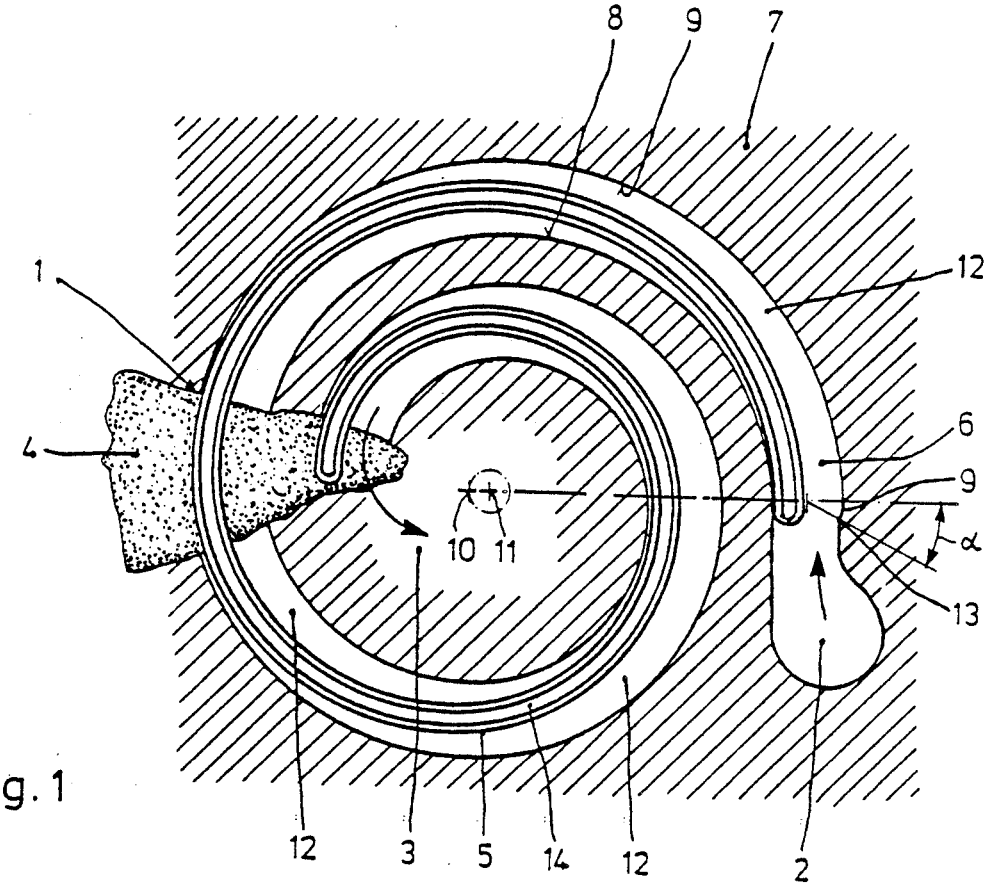
FIG. 1 is a cross-section through a rotary piston compressor, giving an end view of the displacement body.

All parts which are not essential for the understanding of the invention, such as, for example, the drive, the mounting and the guiding of the rotor, and the feed and discharge of the working medium have been omitted from the drawing.

DESCRIPTION OF THE PREFERRED EMBODIMENTS

For the sake of simplicity, the machine shown is represented with only one delivery space 6 and only one displacer. However, the displacer can have a whole system of spirals in the same plane, each of which can, for example, deliver from its own inlet 2 into a common outlet 3.

For an explanation of the mode of operation of the machine, which could be used as a spiral compressor, reference is made to the abovementioned DE-C3 26 03 462. In the text which follows, a brief description is given only of that part of the machine design and the course of the process which is essential for the understanding of the invention.

1 designates the disk-shaped rotor overall. Spirally extending displacement bodies 5 are arranged on one or on both sides of the disk 4. These fit into a delivery space 6 of the fixed housing 7 and form a seal with respect to the latter via sealing strips 14 inserted into the end wall. The delivery space 6 is, for example, machined into the housing 7 in the manner of a spiral-shaped slot. It extends from an inlet 2 arranged at the outer periphery of the spiral in the housing to an outlet 3 arranged in the interior of the housing. It has essentially parallel peripheral walls 8, 9 which are arranged at a uniform mutual interval and here—like the displacement body—encompass a spiral of more than 360°. The displacement body 5 is guided between these peripheral walls 8, 9. The curvature of said displacement body is dimensioned such that it almost touches the inner and outer peripheral walls simultaneously at several points. For this purpose, the center 10 of the displacement body 5 is offset eccentrically relative to the center 11 of the delivery space 6. The spiral shape of delivery space and displacement body is composed of quadrant arcs.

During the operation of the machine, a circular movement of each of the points of the displacement body is established by virtue of the eccentric drive of the disk-shaped rotor 1 carrying the displacement body 5, this circular movement being limited by the peripheral walls of the delivery space. As a consequence of the multiple alternating approach of the displacement body to the inner and outer peripheral walls, crescent-shaped working spaces 12 are created which enclose the working medium. During the circular movement of the displacement body through the delivery space, the working spaces 12 are displaced forwards in the direction of the outlet. The working spaces 12 are produced on both sides of the displacement body. At the same time, the volume of these working spaces decreases and the pressure of the working medium shows a corresponding increase.

Figure 2:
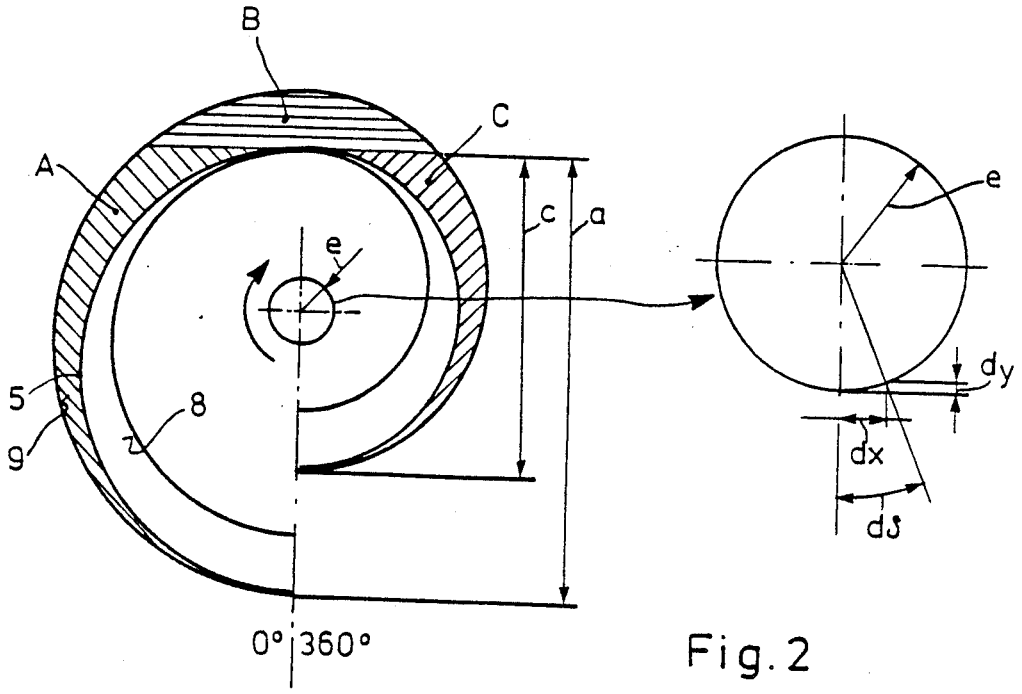
FIG. 2 is a schematic representation relating to the delivery space volume.

The schematic representation according to FIG. 2 illustrates why the geometrically possible intake volume in a machine of this kind is greater than the volume actually enclosed in the first working space. For the sake of simplicity, the spiral shape is produced by two adjoining semicircles. The displacement body 5 is in the 0°/360° position, i.e., in the inlet zone it forms a sealing line with the outer peripheral wall 9. The word line is used because the peripheral walls 8, 9 and the displacement body 5 extend perpendicular to the plane of projection. The intake procedure is complete and the crescent-shaped working space 12 is composed of the three part areas A, B and C.

If the displacer is now moved back by the angle of rotation do then it can be seen, in accordance with the enlarged detail in FIG. 2, that part area A of the crescent-shaped working space is enlarged by the amount $a \times dx$ while part area C decreases by the amount $c \times dx$; part area B remains unaltered. The influence dy of the displacement in the radial direction remains negligible in terms of the change in area. The total area $A+B+C$ increases by the amount $(a-c) \times dx$ by virtue of the angular rotation.

The invention is based on this realization. In order to achieve a maximum possible intake volume, and in accordance with FIG. 1, the actual closing edge 13, i.e. the point at which the displacement body first comes to rest on the outer peripheral wall of the delivery space, is therefore advanced by a certain angle of rotation $\alpha$. It is obvious that an optimum value for the angle $\alpha$ cannot be stated in the present case, since this depends on a large number of parameters, for example the spiral shape, eccentricity, forward edge of the displacement body, pressure drops to be expected etc. It can be seen from the consideration presented above, however, that even small angles lead to results.

The geometry and the mode of operation of the new machine are explained with reference to FIGS. 3–6.

At its inlet edge, the displacement body 5 is rounded off in a manner favorable in terms of flow, here in a semi-circular shape with the radius R1. The center of the semicircle is the geometric locus which rotates on the eccentric circle indicated in broken lines.

Figure 3:
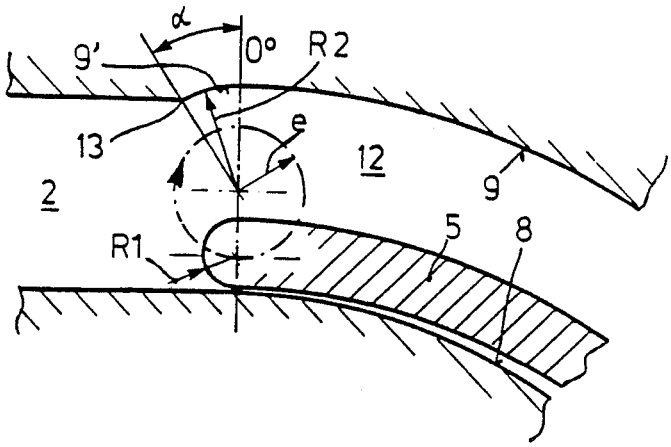
FIGS. 3–6 are views of various working positions of the displacement body.

With respect to the working spaces 12 bounded by the outer peripheral wall 9, the displacer position according to FIG. 3 represents the starting position, i.e. the intake cycle is beginning. The position of the displacer is that which is also represented in FIG. 1 and which is defined as the 180° position. Together with the inner peripheral wall 8, the displacer forms a sealing line and the upper delivery space presents the maximum available opening cross-section to the inlet 2.

Figure 6:
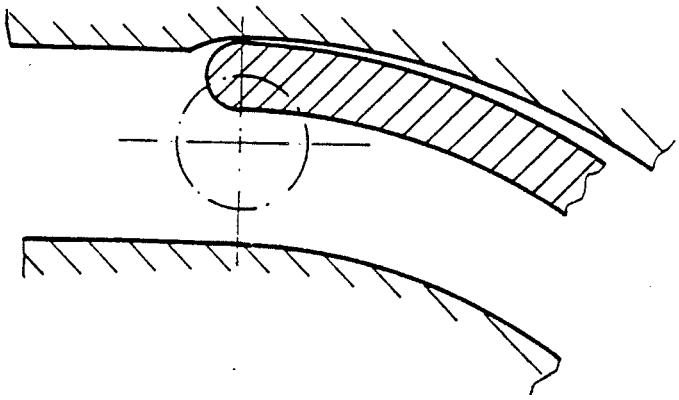

The opposite 0°/360° position is shown in FIG. 6. The displacer 5 rests against the outer peripheral wall 9. In this position the intake procedure is complete without the novel measure.

At the outer peripheral wall 9, the closing edge 13 is advanced by the angle $\alpha$ with respect to the plane which marks the 0°/360° position. Thus, according to FIG. 5, the earliest sealing line during the circular movement of the displacer 5 occurs considerably earlier than is conventionally the case. Accordingly, the intake procedure is completed earlier. Taking into consideration the statements made relating to FIG. 2, the volume enclosed in the working space 12 is greater than that represented in FIG. 6. The significance of this is that the desired compression procedure also begins earlier. For this purpose, however, it is necessary that there should be a continuous seal formed from the closing point 13 to the 0° position to ensure that there is no back-flow from the working space 12 into the inlet 2.

The transition from the peripheral wall 9 to the closing edge 13 is accomplished by means of a circular arc 9'.

The radius R2 of the latter is a function of the inlet edge of the displacer. If the displacement body 5 were to end with a sharp edge, the radius R2 would correspond to the eccentricity e. In the example shown, with a semicircular end, the radius R2 corresponds to the sum of the radii R1 of the semicircle and e of the eccentricity.

Figure 4:
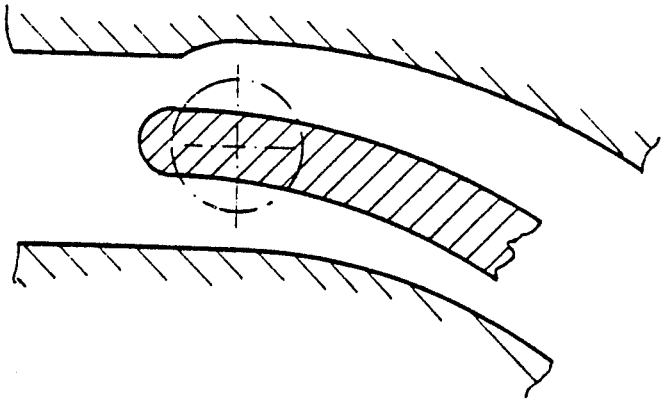
Figure 5:
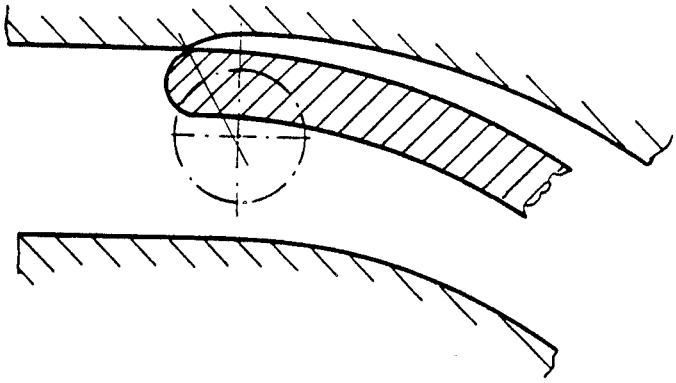

The displacer position according to FIG. 4 i.e. the 270° position, is merely intended to show that the inlet flow cross-section is not prejudiced in any real way by the novel measure. Furthermore, it is obvious that the closing edge 13 does not in fact have to have a sharp edge. A possibly more favorable transition in terms of flow of the circular arc 9' to the channel wall of the inlet 2 is readily conceivable.

A numerical example will illustrate the results which can be achieved. Only the geometries involved are considered here, i.e. any additional gain in terms of backflow prevented is not taken into consideration. The dimensions taken as a basis are such as are very much conventional where the machine is used as a spiral compressor for supercharging internal combustion engines.

The spiral section under consideration, at the outer peripheral wall 9 only the first 360° of the total wrap-round of said spiral section are of importance—i.e. that section which encloses the crescent-shaped working space 12 once intake has ended—is composed of two semi-circles with radii of 68 mm and 52 mm. Let the eccentricity be 4 mm and the closing edge 13 be advanced by the angle of rotation $\alpha = 50°$. In the case of this configuration, it is easy to calculate that an increase in area of 5.1% can be achieved in the working space by virtue of the novel measure.

Obviously, numerously modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rotary piston displacement machine for compressible media, comprising:

a fixed housing;

a side wall of the fixed housing;

outer and inner spiral-shaped peripheral walls extending perpendicularly from the side wall;

a delivery space which is delimited by the outer and inner spiral-shaped peripheral walls extending perpendicularly from the side wall of the fixed housing;

an inlet at the outside of the delivery space;

a channel interconnecting the inlet and the delivery space;

an outlet at the inside of the delivery space;

a rotating rotor; and a spiral-shaped displacement body which projects into the delivery space and is carried by the rotating rotor and is mounted with respect to the delivery space so as to execute a rotary, twist-free movement, said displacement body having a width that is less than the width of the channel so that the displacement body does not obstruct flow through the inlet when the displacement body is before the inlet;

the center of the displacement body is offset eccentrically relative to the center of the peripheral walls in such a way that the displacement body at all times almost touches both the outer and the inner peripheral walls of the delivery space at in each case at least one advancing sealing line;

the spiral shape of the peripheral walls being selected so that when the perpendicular displacement body assumes the 0°/360° position relative to the outer and inner peripheral walls the displacement body rests against the outer peripheral wall;

means for advancing the sealing line at the inlet-side end of the outer peripheral wall so as to advance the sealing line relative to the 0°/360° position by an angle ($\alpha$) between 5° and 50°, said advancing means including a circular arc in the outer peripheral wall at this angle region;

whereby the maximum theoretical inlet volume is achieved in the delivery space between the displacement body and the outer peripheral wall before the rotating rotor which carries the perpendicular displacement body assumes the 0°/360° position relative to the outer and inner peripheral walls.

2. A rotary piston displacement machine as claimed in claim 1, wherein the inlet edge of the displacement body has a semicircular edge, and (5), the circular arc has a radius which corresponds to the sum of the radii of the semicircular inlet and eccentricity.

* * * * *